United States Patent [19]

Needham

[11] B 3,994,345

[45] Nov. 30, 1976

[54] METHOD OF RECOVERING OIL USING STEAM

[75] Inventor: Riley B. Needham, Bartlesville, Okla.

[73] Assignee: Phillips Petroleum Company, Bartlesville, Okla.

[22] Filed: Dec. 5, 1974

[21] Appl. No.: 529,836

[44] Published under the second Trial Voluntary Protest Program on February 3, 1976 as document No. B 529,836.

[52] U.S. Cl. ..... 166/303

[51] Int. Cl.[2] ..... E21B 43/24

[58] Field of Search ..... 166/303, 263, 272, 245, 166/305 R, 273

[56] References Cited

UNITED STATES PATENTS

| | | | |
|---|---|---|---|
| 3,207,218 | 9/1965 | Holbrook et al. | 166/305 R |
| 3,259,186 | 7/1966 | Dietz | 166/263 |
| 3,306,354 | 2/1967 | Obrien | 166/263 X |
| 3,354,958 | 11/1967 | Parker | 166/303 |
| 3,357,487 | 12/1967 | Gilchrist et al. | 166/245 |
| 3,396,792 | 8/1968 | Muggee | 166/303 |
| 3,412,793 | 11/1968 | Needham | 166/303 X |
| 3,434,544 | 3/1969 | Satter et al. | 166/303 |
| 3,618,666 | 11/1971 | Sayers | 166/303 |
| 3,648,772 | 3/1972 | Earlougher, Jr. | 166/273 |

*Primary Examiner*—Stephen J. Novosad

[57] ABSTRACT

A method of recovering hydrocarbon from a hydrocarbon-bearing formation by the use of steam in which after the steam is injected into the formation a material is injected which will cause the production of a condensable foam blocking zone so that the well can be put into production and during said production much of the steam will be maintained in the formation until the foam condenses, thereby providing more efficient use of the heat in the steam.

10 Claims, No Drawings

METHOD OF RECOVERING OIL USING STEAM

This invention relates to an improved method for recovering hydrocarbon material from producing formations. In another aspect, this invention relates to a steam-stimulation process for recovering hydrocarbon material from producing formations. In still another aspect, it relates to an improvement in the "huff and puff" method of steam-stimulation of hydrocarbon-bearing formations.

The primary production of petroleum hydrocarbons from oil-bearing formations is usually effected by drilling through or into the oil-bearing sand and providing access to the formation around the bore hole so as to permit oil to flow into the bore hole from which it may be recovered by conventional methods. If the formation contains an oil of low or medium viscosity at reservoir conditions, the well may be produced either by flowing or pumping in the conventional manner. If, on the other hand, the formation contains a highly viscous oil at reservoir conditions, it may be necessary to heat the formation in the vicinity of the bore hole to reduce the viscosity of the oil so that the oil may flow into the bore hole. In time, even the wells containing free-flowing oil become uneconomical to produce, although a substantial amount of oil still remains in the producing formation. The residual oil left in the formation after primary production, or the oil which is highly viscous at reservoir conditions, is very difficult to produce and considerable research has been carried out on methods of recovering this residual, or highly viscous oil. Such methods of increasing the production of residual or highly viscous oils are sometimes called stimulation techniques. Various stimulation techniques have been devised, such as heating a formation by means of preheated fluids, e.g., gases, steam, or water, combustion in situ, flooding the formation with water, hot water, steam, or immiscible fluid, etc.

One technique of steam-stimulation of hydrocarbon-bearing formations is the so-called "huff and puff" method wherein steam is injected into a formation through a single drill hole or well until substantial steam pressure has been built up in the formation. Following this step, the well is maintained in a closed condition such that the formation is submitted to a "soaking" which enables the steam in a formation to deliver heat to the high-viscosity oil in that formation. The "soaking" is continued until portions of the high-viscosity hydrocarbons have received enough heat that they will flow more readily through the formation into the well bore. Then the well is put into production by such conventional means as fluid pressure or pumping so that the lowered viscosity hydrocarbons may be recovered from the well.

One drawback to the huff and puff method is that the efficient use of the heat in the steam requires long shut-in periods for the well which may be for a period of about two weeks. When the shut-in periods are shortened, considerable amounts of steam are produced along with the hydrocarbon with the concomitant result of the waste of the heat energy in the steam.

Accordingly, it is an object of this invention to provide a huff and puff type steam-stimulation technique in which shut-in time is minimized. Further, it is an object of this invention to provide a huff and puff technique in which the steam is used more efficiently.

These and other objects will be apparent from a study of this disclosure and the appended claims.

According to this invention, the injection of steam into the hydrocarbon-bearing formation is followed by the injection into the formation of a material which will cause to be formed in the formation a condensable foam blocking zone which will tend to inhibit the flow of steam back into the well bore whereby the well may be put into production. This allows recovery of fluids that flow into the well bore without the concomitant loss of steam still in the formation which is capable of transferring still more heat to the formation for lowering the viscosity of the desired material in the formation. In other words, it allows the pumping of fluids from the well bore while there is still useful steam in the formation without the accompanying result that much of the "active" steam will be drawn back out of the formation and pumped back to the surface along with the other fluids. Unlike prior art processes, when this process is employed there is no need to wait for some predetermined arbitrarily fixed period of time to insure that all the steam has been efficiently employed. According to this process, one can put the well into production while there is still active steam present in the formation. As the foam condenses in the various zones the fluids can flow into the well bore from where they can be pumped to the surface even though there may be other zones in which the steam is still active. The active steam in those zones will be held until enough heat has been transferred in that zone of the formation to result in the condensation of the blocking foams. It will thus be seen that by this invention a steam stimulation technique is provided in which production time is increased and the flow of steam back into the well bore during production is minimized.

In the inventive process, the injection of the steam is accomplished in a conventional manner.

The formation of the condensable foam blocking zone in the formation following the injection of steam can be provided by injecting a condensable foam directly into the formation or by injecting a material into the formation which upon production of the well will interact with steam being drawn back to the well bore to produce a condensable foam.

A method for preparing a condensable foam for injection into a formation is contained in U.S. Pat. No. 3,412,793, issued Nov. 26, 1968, to this same inventor. The disclosure of this patent is incorporated herein by reference. This patent discloses that a condensable foam can be formed by injecting a small amount of a surface active agent directly into a condensable gas which is being pumped into the well.

As is pointed out in the patent, although steam is a condensable gas which has been often used, it is evident that any gas which is condensable at the temperature and pressure conditions in the particular formation could be used to produce such a collapsing foam. Of course, the lifetime of the collapsible foam can be varied as taught in the patent; however, to maximize the efficient use of steam in the steam-stimulation process it should be evident that it would be desirable if the foam did not substantially condense until substantially all of the heat in the steam that could be transferred to the formation had been transferred.

The formation of a condensable foam for injection into the formation from a condensable gas and a surface-active agent can be formed by employing a foam generating means such as a jet mixer, venturi, orifice, or pressure reducing valve. The foam can be produced at the surface of the well bore or at some point within the well bore. It should be evident that if additional pressure is necessary for the injection of the foam into the formation, some additional gas can be used to supply the driving force.

An alternative method of preparing a collapsible foam which can be injected into the formation comprises injecting into the condensable gas a surface-active agent dissolved or dispersed in a liquid such as water, gasoline, kerosene, jet fuel, Stoddard solvent, benzene, xylene, toluene, fuel oil, gas oil, diesel oil, or crude oil compatible with the crude to be produced. As previously indicated, additional gas can be used to provide the pressure which will force the resulting foam into the formation.

A third method of providing a condensable foam blocking zone in the formation comprises injecting into the formation a surface-active agent dissolved or dispersed in a liquid. The liquid would be one such as described in the preceding paragraph. When the well is put into production, the steam which is drawn from the formation to the well bore will upon contacting the surfactant-containing liquid form a condensable foam in that area of the formation, thus inhibiting the passage of additional steam into the well bore until after the foam collapses. The collapse of the foam takes place when the gaseous steam phase of the foam drops in temperature until the steam condenses to form water, that is, the foam will collapse when the temperature of the steam is lowered below the boiling point of water at that particular down hole pressure.

Various types of surface-active agents can be used in this embodiment of the invention, either nonionic, anionic, or cationic. Commercial surface-active agents of the alkyl phenoxy polyethoxy ethanol class and commonly available household cleansers would be satisfactory. For example, Trend detergent manufactured by Purex Corporation, Ltd., would be satisfactory as well as other household cleaning compounds, hand and laundry soaps, and rug shampoos. Nonionic type surface-active agents such as Triton X-100 and Igepal CO-990 are examples of the alkyl phenoxy polyethoxy ethanol class which are satisfactory in the practice of this invention. Anionic type surface-active agents such as Alconox and Trend are examples of the alkyl aryl sulfonate class useable in the practice of this invention. Ethomeen 18/60 and Arquad C-50 are examples of cationic surface-active agents which are useable in this invention, and identified chemically as stearyl amine polyethylene oxide and n-alkyl trimethyl ammonium chloride, respectively.

In this third method of preparing a collapsible foam in the formation the time in which the foam will collapse can also be adjusted by adding greater or lesser amounts of the foaming agent to the liquid in which it is dissolved or dispersed. The injection of the dispersion or solution of surface-active agent into the formation, can be accomplished by the use of a pressurizing gas if such additional pressure is required to force the dispersion or solution into the formation.

Regardless of the method chosen for the production of the foam in the formation, it should be evident that as in conventional steam-stimulation processes it is preferred that first a sufficient amount of steam be injected into the formation to insure that a substantial amount of the hydrocarbon in the formation will be heated so that its viscosity will be lowered. Typically, this would involve injecting steam, which can range in temperature from about 300° to 700°F or higher, for a period of from about 2 to about 30 days. Also, it should be evident that for the most effective use of the steam it is preferred that the condensable foam be such that it will block the passage of the steam into the well until the steam has transferred to the formation substantially all of the heat that can be transferred.

If the foam collapses too quickly, or if the amount of foam in the formation is not adequate, one practicing this invention will observe that the production of steam has not decreased significantly. The collapsing time and the amount of the foam in the formation can be varied to control the length of time that the steam is blocked from passing into the well from the formation. From a knowledge of the formation temperature, one skilled in the art of producing hydrocarbon formations can readily estimate how much heat the steam could lose and thus what life span would be most desirable for the collapsable foam. Further, using the techniques of varying the collapsing time of the condensable foam, as already described in this disclosure, one skilled in the art could thus empirically determine the optimum collapsing time for the foam. Likewise, the proper amount of collapsible foam for the formation can be determined by observing the quantity of hot steam obtained during production. Thus, the size and life of the blocking zone in the formation are a matter of choice that can be varied to provide the desired amount of blockage.

The benefits of this steam stimulation technique is shown by the following example:

Steam is injected into a shallow well (depth 1,200 feet) at a temperature of about 325°F, at a quality of 80 percent, and at a rate of 400,000 pounds per day (injection zone 20 feet of 150 feet of pay). After two weeks of steam injection a surfactant dispersion of about 1,000 pounds of Triton X-305 (octylphenol-ethylene oxide reaction product in which on the average 30 mols of ethylene oxide are reacted per mol of octylphenol manufactured by Rohm and Haas) in 1,400 barrels of hot water are injected. Thereafter the well is placed back on production and any of the steam channeling through the surfactant solution causes a foam which blocks steam flow. This results in the steam finding an alternate, lower temperature zone where the heat will be transferred to the oil and formation, thus providing a more efficient steam stimulation process. As the steam condenses and foam collapses the plugged channels open up to produce oil.

It is to be understood that the foregoing disclosure is given only as an illustration and example to enable those skilled in the art to understand and practice the invention. Illustrative details disclosed are not to be construed as limitations on the invention. Obvious modifications and variations will be within the scope of the following claims.

I claim:

1. A process for increasing the efficiency of steam utilization and reducing the shut-in time in the steam stimulation of a hydrocarbon bearing formation comprising, 1. injecting into said formation through a well penetrating said formation steam in a sufficient quantity to heat substantial amounts of the hydrocarbon in said formation,
2. then injecting into said formation through said well a material which will cause the production in the formation of a condensable foam blocking zone, and 3. after the injection of step (2) putting said well into production while there is still active steam in the formation behind the material injected in step (2).

2. A process according to claim 1 wherein the material injected into the formation in step (2) is a liquid containing a surface-active agent and the collapsible foam is produced when portions of the steam in the formation pass through said liquid when the well is put into production.

3. A process according to claim 2 wherein the material injected into the formation in step (2) is an aqueous solution of a water-soluble surfactant.

4. A process according to claim 1 wherein the material injected into the formation in step (2) is a condensable foam resulting from the mixture of a condensable gas with a surface-active agent.

5. A process according to claim 4 wherein the condensable gas is steam.

6. A process according to claim 5 wherein the foam is formed employing a foam generating means such as a jet mixer, venturi, orifice, or pressure reducing valve.

7. A process according to claim 5 wherein the foam is produced at the surface of the well.

8. A process according to claim 5 wherein the foam is produced within the well bore.

9. A process according to claim 4 wherein the surface-active agent is contained in a liquid.

10. A process according to claim 1 wherein the foam that is formed in the formation will not condense until the initially injected steam has lost substantially all the heat that it can transfer to the formation.

* * * * *